US010920758B2

(12) United States Patent
Colavincenzo

(10) Patent No.: US 10,920,758 B2
(45) Date of Patent: Feb. 16, 2021

(54) HYPOCYCLOID COMPRESSOR

(71) Applicant: Bendix Commercial Vehicle Systems LLC, Elyria, OH (US)

(72) Inventor: David D. Colavincenzo, Castalia, OH (US)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 292 days.

(21) Appl. No.: 16/023,557

(22) Filed: Jun. 29, 2018

(65) Prior Publication Data

US 2020/0003197 A1 Jan. 2, 2020

(51) Int. Cl.
*F04B 27/053* (2006.01)
*F04B 39/06* (2006.01)
(Continued)

(52) U.S. Cl.
CPC ..... *F04B 27/053* (2013.01); *F04B 39/06* (2013.01); *F04B 45/022* (2013.01); *F04B 45/043* (2013.01)

(58) Field of Classification Search
CPC ..... F04B 1/043; F04B 9/045; F04B 25/005; F04B 27/0414; F04B 27/053; F04B 35/01;
(Continued)

(56) References Cited

U.S. PATENT DOCUMENTS 2,423,701 A * 7/1947 Hardy ..... F04B 1/0413 417/273
3,152,753 A * 10/1964 Adams ..... F04B 39/06 417/53
(Continued)

FOREIGN PATENT DOCUMENTS

DE 14 28 007 A1 12/1968
DE 10 2005 052 623 A1 5/2007
(Continued)

OTHER PUBLICATIONS

"Hypocycloid." Wikipedia, Wikimedia Foundation, Mar. 24, 2020, en.wikipedia.org/wiki/Hypocycloid. (Year: 2020).*
(Continued)

*Primary Examiner* — Patrick Hamo
*Assistant Examiner* — Joseph S. Herrmann
(74) *Attorney, Agent, or Firm* — Reising Ethington P.C.

(57) ABSTRACT

A compressor includes a stationary housing disposed about a central axis and having a radially inner surface defining a plurality of circumferentially spaced cavities opening into an interior space of the housing. The compressor further includes a plurality of fluid volume control members, each of which is disposed within one of the plurality of cavities and defines a fluid chamber within the cavity sealed relative to the interior space. An eccentric shaft is disposed within the interior space of the housing and configured for rotation about the central axis. A hypocycloid rotor is disposed within the interior space of the housing and supported on the eccentric shaft. The rotor defines a plurality of lobes configured for movement into and out of each cavity responsive to rotation of the shaft to displace the fluid volume control member in each cavity and adjust a volume of each fluid chamber.

20 Claims, 4 Drawing Sheets

(51) Int. Cl.
*F04B 45/02* (2006.01)
*F04B 45/04* (2006.01)

(58) Field of Classification Search
CPC .... F04B 39/06; F04B 43/0045; F04B 43/026; F04B 43/04; F04B 45/022; F04B 45/043; F04C 18/1075; F04C 18/088; F04C 5/00
See application file for complete search history.

(56) References Cited

U.S. PATENT DOCUMENTS

| | | | | |
|---|---|---|---|---|
| 3,195,808 | A * | 7/1965 | Holt | F04B 39/1073 417/239 |
| 3,250,225 | A * | 5/1966 | Taplin | F04B 35/04 417/413.1 |
| 3,622,251 | A * | 11/1971 | Allen | F04B 27/053 417/471 |
| 3,771,901 | A * | 11/1973 | Svensson | F04C 5/00 418/156 |
| 4,610,606 | A * | 9/1986 | Hazzard | F04B 39/0005 417/273 |
| 5,947,697 | A * | 9/1999 | Morrison | F04B 39/125 417/237 |
| 5,988,998 | A | 11/1999 | Glover | |
| 7,008,200 | B2 | 3/2006 | Holtzapple et al. | |
| 7,695,260 | B2 | 4/2010 | Holtzapple et al. | |
| 8,753,099 | B2 | 6/2014 | Holtzapple et al. | |
| 9,022,746 | B2 * | 5/2015 | Kroupa | F04B 43/026 417/53 |
| 9,657,734 | B2 | 5/2017 | Holtzapple et al. | |
| 10,408,201 | B2 * | 9/2019 | Smith | F04B 35/01 |
| 2014/0301865 | A1 * | 10/2014 | Lull | F04B 27/0423 417/53 |
| 2017/0058879 | A1 * | 3/2017 | Smith | F04B 25/00 |

FOREIGN PATENT DOCUMENTS

| | | | |
|---|---|---|---|
| DE | 102015120240 | B3 | 2/2017 |
| EP | 3073133 | A1 | 9/2016 |
| FR | 909 344 | A | 5/1946 |
| GB | 961 872 | A | 6/1964 |
| WO | 20010007788 | A1 | 2/2001 |
| WO | 20130100344 | A1 | 7/2013 |

OTHER PUBLICATIONS

English language abstract for DE 10 2015 120 240 B3.
English language abstract for WO 2001/0007788 A1.
English language abstract for WO 2013/0100344 A1.
International Search Report issued in corresponding International (PCT) App. No. PCT/US2019/037599 (dated Sep. 12, 2019).
Written Opinion issued in corresponding International (PCT) App. No. PCT/US2019/037599 (dated Sep. 12, 2019).

* cited by examiner

HYPOCYCLOID COMPRESSOR

BACKGROUND OF THE INVENTION a. Field of the Invention

This invention relates to a compressor used in vehicle brake systems. In particular, this invention relates to a compressor that generates a relatively smooth torque profile and has a relatively high efficiency to facilitate use with an electric motor.

b. Background Art

Conventional vehicles commonly include wheel brakes at each wheel on the vehicle that are activated by fluid pressure. A fluid control circuit on the vehicle includes a compressor that draws in outside air and compresses the air, a fluid reservoir that stores the compressed air and a plurality of electronically or pneumatically controlled valves that control delivery of the pressurized fluid from the fluid reservoir to the wheel brakes. Increasing use of electricity to provide power within vehicles has led to the use of electric motors to drive the compressor. Some common types of compressors, however, do not work well with electric motors. In particular, a typical positive displacement, reciprocating single or dual cylinder compressor has a relatively high peak torque and a significant rotational imbalance that can negatively affect the operation of the electric motor. A typical rotary compressor has improved rotational balance, but is relatively inefficient due to leakage past the vanes of the compressor.

The inventors herein have recognized a need for a compressor that will minimize and/or eliminate one or more of the above-identified deficiencies.

BRIEF SUMMARY OF THE INVENTION

This invention relates to a compressor used in vehicle brake systems. In particular, this invention relates to a compressor that generates a relatively smooth torque profile and has a relatively high efficiency to facilitate use with an electric motor.

A compressor in accordance with one embodiment includes a stationary housing disposed about a central axis and having a radially inner surface defining a plurality of circumferentially spaced cavities opening into an interior space of the housing. The compressor further includes a plurality of fluid volume control members. Each of the plurality of fluid volume control members is disposed within one of the plurality of cavities and defines a fluid chamber within the cavity sealed relative to the interior space. In accordance with various embodiments, the fluid volume control members may comprise diaphragms, bellows or pistons. The compressor further includes an eccentric shaft disposed within the interior space of the housing and configured for rotation about the central axis. The compressor further includes a hypocycloid rotor disposed within the interior space of the housing and supported on the eccentric shaft. The hypocycloid rotor defines a plurality of lobes configured for movement into and out of each cavity of the plurality of cavities responsive to rotation of the eccentric shaft about the central axis to displace the fluid volume control member in each cavity and adjust a volume of each fluid chamber.

A compressor in accordance with another embodiment includes a stationary housing disposed about a central axis and having a radially inner surface defining a first plurality of circumferentially spaced cavities opening into a first interior space of the housing and a second plurality of circumferentially spaced cavities opening into a second interior space of the housing. The first plurality of cavities and first interior space are axially spaced from the second plurality of cavities and second interior space. The compressor further includes a first plurality of fluid volume control members. Each of the first plurality of fluid volume control members is disposed within one of the first plurality of cavities and defines a fluid chamber within the cavity sealed relative to the first interior space. The compressor further includes a second plurality of fluid volume control members. Each of the second plurality of fluid volume control members is disposed within one of the second plurality of cavities and defines a fluid chamber within the cavity sealed relative to the second interior space. In accordance with various embodiments, the fluid volume control members may comprise diaphragms, bellows or pistons. The compressor further includes an eccentric shaft disposed within the interior space of the housing and configured for rotation about the central axis. The compressor further includes a first hypocycloid rotor disposed within the first interior space of the housing and supported on the eccentric shaft. The first hypocycloid rotor defines a plurality of lobes configured for movement into and out of each cavity of the first plurality of cavities responsive to rotation of the eccentric shaft about the central axis to displace the first fluid volume control member in each cavity and adjust a volume of each fluid chamber. The compressor further includes a second hypocycloid rotor disposed within the second interior space of the housing and supported on the eccentric shaft. The second hypocycloid rotor defines a plurality of lobes configured for movement into and out of each cavity of the second plurality of cavities responsive to rotation of the eccentric shaft about the central axis to displace the second fluid volume control member in each cavity and adjust a volume of each fluid chamber.

A method for compressing fluid in accordance with one embodiment includes the step of providing a compressor. The compressor comprise a stationary housing disposed about a central axis and having a radially inner surface defining a plurality of circumferentially spaced cavities opening into an interior space of the housing. The compressor further comprises a plurality of fluid volume control members. Each of the plurality of fluid volume control members is disposed within one of the plurality of cavities and defines a fluid chamber within the cavity sealed relative to the interior space. The compressor further comprises an eccentric shaft disposed within the interior space of the housing and configured for rotation about the central axis. The compressor further comprises a hypocycloid rotor disposed within the interior space of the housing and supported on the eccentric shaft. The hypocycloid rotor defines a plurality of lobes. The method further includes the step of rotating the eccentric shaft and hypocycloid rotor about the central axis wherein the plurality of lobes on the hypocycloid rotor move into and out of each cavity of the plurality of cavities to displace the fluid volume control member in each cavity and adjust a volume of each fluid chamber.

A compressor in accordance the present teachings represent an improvement as compared to conventional compressors. In particular, the compressor disclosed herein has a relatively smooth torque profile and is capable of operating smoothly at relatively high speeds unlike conventional positive displacement, reciprocating compressors. Further, the compressor reduces or eliminates fluid leakage past the compressor vanes and is therefore more efficient than conventional positive displacement, rotary compressors. As a result, the compressor facilitates the use of electric motors to drive the compressor.

The foregoing and other aspects, features, details, utilities, and advantages of the present invention will be apparent from reading the following description and claims, and from reviewing the accompanying drawings.

DETAILED DESCRIPTION OF THE INVENTION

Figure 1:
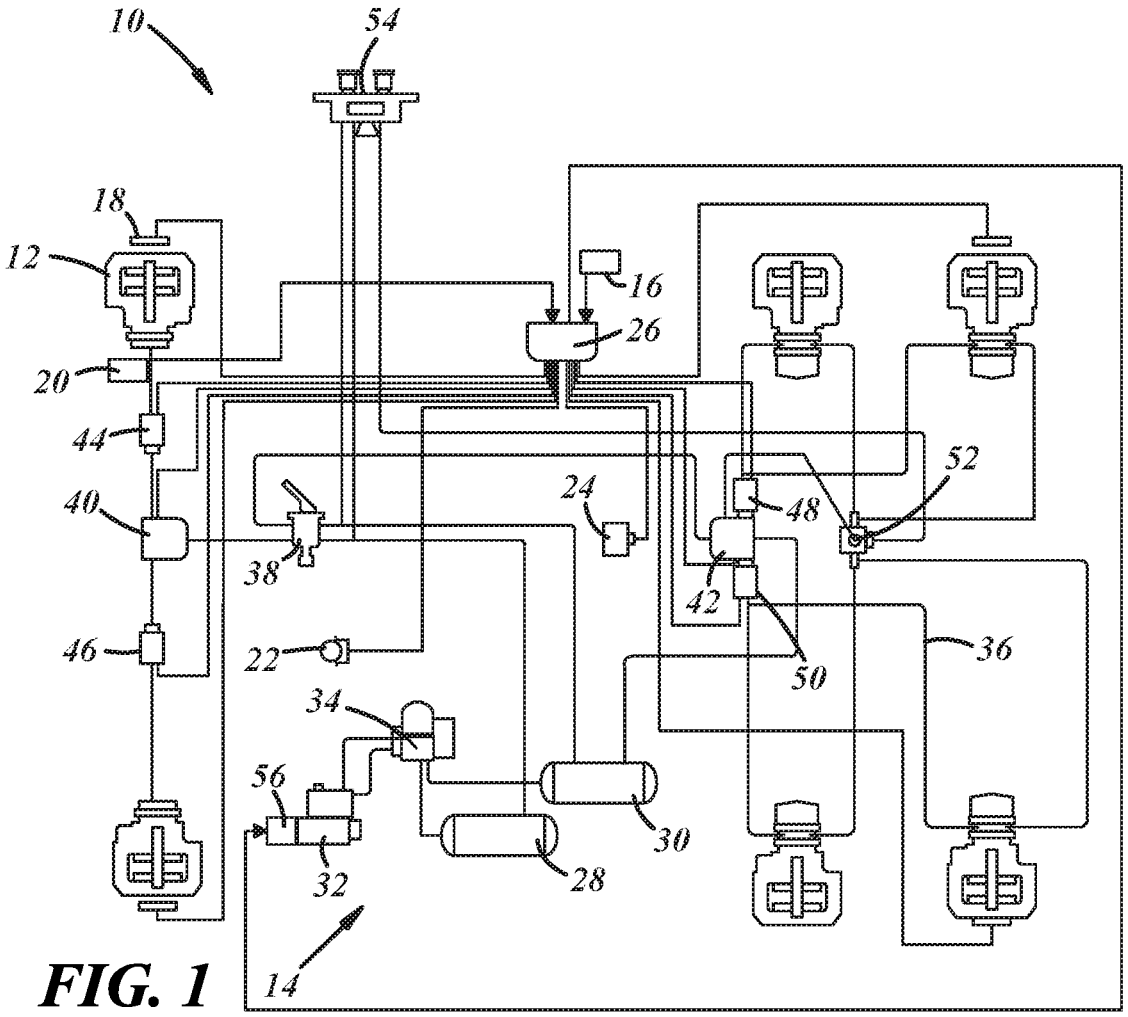
FIG. 1 is a diagrammatic view of a tractor-trailer incorporating a system for controlling wheel brakes on the trailer in accordance with the present teachings.

Referring now to the drawings wherein like reference numerals are used to identify identical components in the various views, FIG. 1 illustrates a braking system 10 configured to brakes wheels on a vehicle in order to slow or stop movement of the vehicle. In the illustrated embodiment, the vehicle comprises a tractor of a tractor-trailer. It should be understood, however, that the braking system disclosed herein could be used to control wheel brakes in a wide variety of vehicles. Further, although the illustrated embodiment shows system 10 as applied to control wheel brakes in the tractor of a tractor-trailer, it should be understood that system 10 could be configured to control wheel brakes in the trailer as well. System 10 may be configured to communicate with other vehicle systems over a conventional vehicle communication bus such as a controller area network (CAN) (or another communication medium such as power line communication (PLC)) including, for example, advanced driver assistance systems such as collision avoidance systems that are configured to implement automated emergency braking (AEB) of the vehicle wheels under certain conditions. Braking system 10 may include wheel brakes 12, a fluid circuit 14 that supplies fluid pressure to wheel brakes 12, various sensors 16, 18, 20, 22, 24 and one or more controllers 26.

Wheel brakes 12 are configured to apply a braking force to one or more wheels. In the illustrated embodiment, brakes 12 comprise disc brakes in which a carrier supports brake pads on opposite sides of a rotor rotating with the wheel and an actuator causes, responsive to fluid pressure delivered by fluid circuit 14, movement of a caliper relative to the carrier to move the brake pads into and out of engagement with the rotor. It should be understood, however, that one or more of wheel brakes 12 may alternatively comprise drum brakes in which an actuator such as a cam or piston causes, responsive to fluid pressure delivered by fluid circuit 14, movement of one or more brake shoes into engagement with a braking surface in a brake drum rotating with the wheel.

Fluid circuit 14 generates fluid pressure within system 10 and controls the delivery of fluid pressure to the actuator of each wheel brake 12. Circuit 14 may include components for generating and storing pressurized fluid including fluid reservoirs 28, 30, a compressor 32, and air dryer 34 and components for routing and delivering fluid pressure to wheel brakes 12 including fluid conduits 36 and various valves including foot pedal valve 38, relay valves 40, 42, modulator valves 44, 46, 48, 50, quick release valve 52, and dash control valve 54.

Fluid reservoirs 28, 30 store compressed fluid for use in applying wheel brakes 12. Reservoir 28 supplies pressurized fluid to the wheel brakes 12 for the steer axle and has a fluid port coupled to air dryer 34 and fluid ports coupled to relay valve 40. Reservoir 30 supplies pressurized fluid to the wheel brakes for the drive axles and has a fluid port coupled to air dryer 34 and fluid ports coupled to relay valve 42.

Compressor 32 draws in air and compresses the air for delivery to reservoirs 28, 30 through air dryer 34. Compressor 32 has one or more fluid ports coupled to air dryer 34. Compressor 32 may be driven by an electric motor 56 under the control of a controller such as controller 26 and is described in greater detail below.

Air dryer 34 is provided to collect and remove solid, liquid and vapor contaminants from pressurized fluid. Air dryer 34 is disposed between compressor 32 and reservoirs 28, 30 and has fluid ports coupled to compressor 32 and each reservoir 28, 30.

Fluid conduits 36 are used to transport fluid between reservoirs 28, 30 compressor 32, air dryer 34, valves 38, 40, 42, 44, 46, 48, 50, 52, 54 and wheel brakes 12. Conduits 36 may be made from conventional metals and/or plastics and have connectors at either end configured to join the conduits 36 to corresponding components of circuit 14.

Valves 38, 40, 42, 44, 46, 48, 50, 52, 54 are provided to control distribution of fluid throughout fluid control circuit 14. Foot pedal valve 38 is provided to allow controlled application of the brakes 12 by the vehicle operator by selectively releasing fluid pressure from fluid reservoirs 28, 30 and is supported within the cabin of the vehicle. Actuation of valve 38 by the vehicle operator allows fluid pressure to flow from reservoirs 28, 30 to relay valves 40, 42. Relay valves 40, 42 increase the volume of fluid, and therefore the speed, at which fluid is delivered to, and exhausted from, wheel brakes 12 in order to eliminate lag times between the commanded and actual application and release of brakes 12. Relay valves 40, 42 may operate under the control of controller 26 to implement anti-lock braking/traction control when required. Modulator valves 44, 46, 48, 50 are provided to implement an anti-lock braking function. During normal braking, valves 44, 46, 48, 50 allow fluid pressure to pass from relay valves 40, 42 to wheel brakes 12 without interference. During a loss of traction, however, signals from controller 26 cause valves 44, 46, 48, 50 to modulate the fluid pressure to prevent lockup of the wheels. Quick release valve 52 increases the speed at which fluid pressure is exhausted from wheel brakes 12 on the drive axle when brakes 12 are released. Dash control valve 54 allows the vehicle operator to implement several functions including releasing parking brakes on the vehicle by supplying fluid pressure to oppose spring forces in the actuators for wheel brakes 12.

Sensors 16, 18, 20, 22, 24 are provided to identify various conditions associated with the vehicle and surrounding environment that impact the operation of braking system 10.

Sensor 16 comprises an engine or transmission speed sensor that generates a signal indicative of the speed of the vehicle. Sensor 18 comprises a wheel speed sensors that generate signals indicative of the rotational speed of a corresponding wheel and from which controller 26 can determine the speed of the vehicle and whether certain wheels are slipping and implement anti-lock braking through control of relay valves 40, 42 and modulator valves 44, 46, 48, 50. Sensors 20 comprise pressure sensors that generate signals indicative of the fluid pressure at various locations within fluid circuit 14. Sensor 22 comprises a steer angle sensor that generates a signal indicative of a steering angle imparted by a vehicle operator to a steering wheel in the vehicle. Sensor 24 comprises a yaw rate sensor that generates a signal indicative of the angular velocity of the vehicle about its vertical (yaw) axis. It should be understood that the above described sensors are exemplary and that additional sensors may be used to identify other conditions that may impact the operation of braking system 10 including, for example, load sensors that generate signals indicative of the forces at various locations on the vehicle.

Controller 26 controls the operation of relay valves 40, 42 and modulator valves 44, 46, 48, 50 in order to control the fluid pressure delivered to wheel brakes 12 and, therefore, the braking force applied to the wheels. Controller 26 may comprise a programmable microprocessor or microcontroller or may comprise an application specific integrated circuit (ASIC). Controller 26 may include a memory and a central processing unit (CPU). Controller 26 may also include an input/output (I/O) interface including a plurality of input/output pins or terminals through which the controller 26 may receive a plurality of input signals and transmit a plurality of output signals. The input signals may include signals received from sensors 16, 18, 20, 22, 24 and other vehicle systems. The output signals may include signals used to control relay valves 40, 42 and modulator valves 44, 46, 48, 50 as well as electric motor 56 used in driving compressor 32. Controller 26 may be configured with appropriate programming instructions (i.e., software or a computer program) to implement the control of wheel brakes 12.

Figure 2:
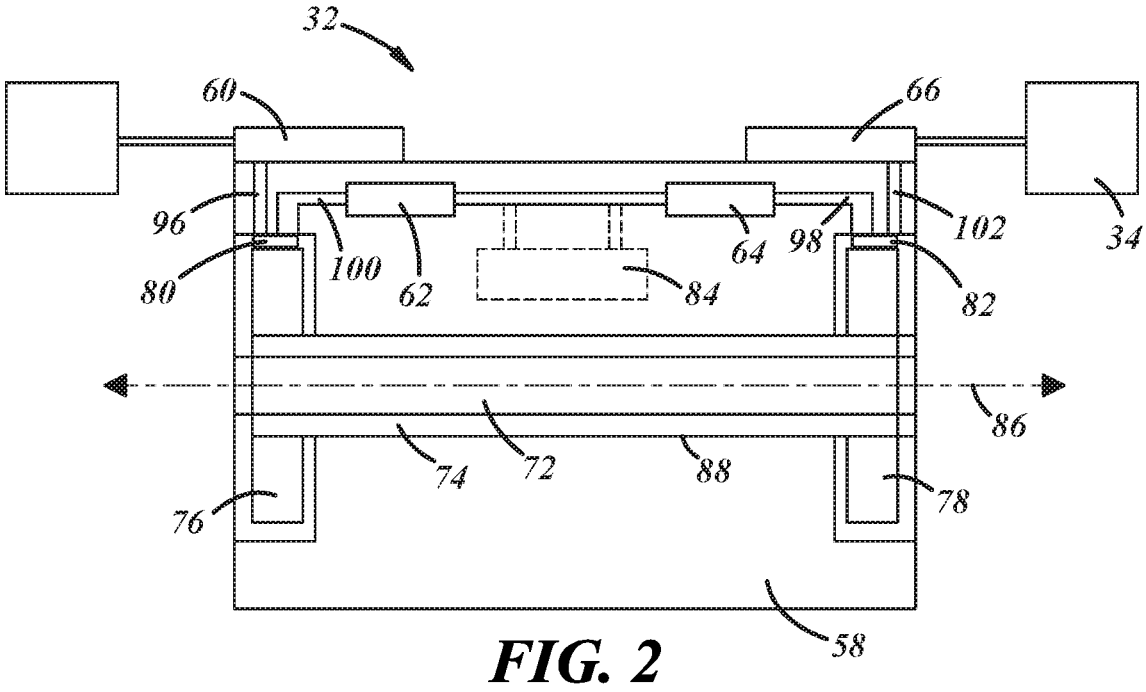
FIG. 2 is a diagrammatic view of a compressor of the system for controlling wheel brakes of FIG. 1 in accordance with the present teachings.
Figure 3:
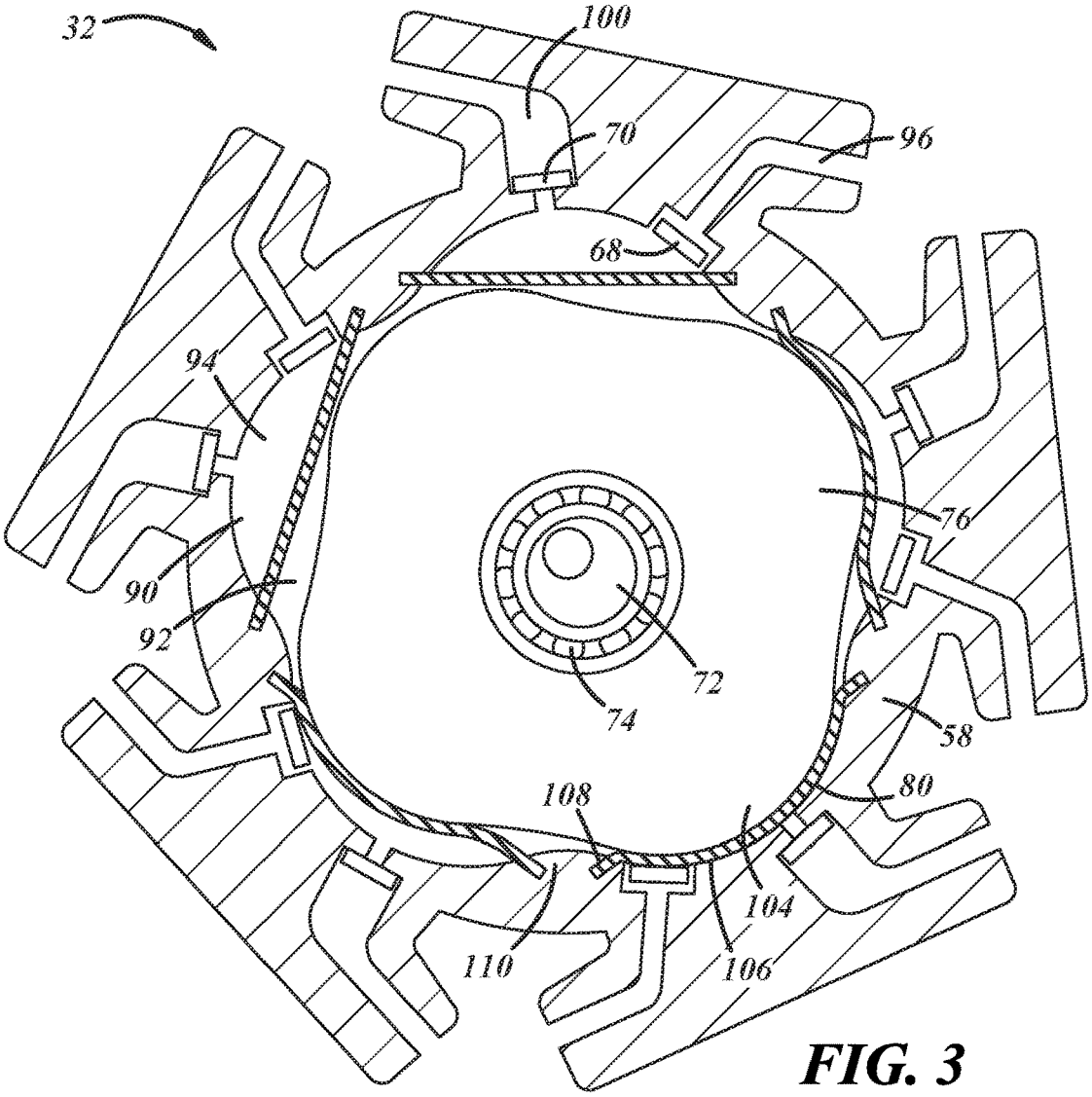
FIG. 3 is cross-sectional view of a portion of a compressor in accordance with one embodiment of the present teachings.

Referring now to FIGS. 2-3, compressor 32 will be described in greater detail. Compressor 32 is provided to compress air for storage within reservoirs 28, 30 and subsequent use within fluid circuit 14 and brake system 10 to control wheel brakes 12. Compressor 32 may include a housing 58, fluid intake and discharge manifolds 60, 62 and 64, 66, inlet and outlet valves 68, 70, an eccentric shaft 72, a bearing 74, one or more rotors 76, 78, and one or more pluralities of fluid volume control members 80, 82. In the illustrated embodiment, compressor 32 is configured as a multi-stage compressor with an intercooler 84. It should be understood, however, that compressor 32 could be configured as a single stage compressor with a single rotor, a single stage compressor with multiple rotors, a multi-stage compressor without cooling or a multi-stage compressor having more than two stages.

Housing 58 positions and orients the other components of compressor 32 and defines a fluid pathway for intake and distribution of fluid within compressor 32. Housing 58 is a stationary body relative to rotors 76, 78. Housing 58 may be made from conventional metals or plastics. Referring to FIG. 2, housing 58 is annular in shape and disposed about a central axis 86. Housing 58 defines a central bore 88 configured to receive shaft 72 and bearing 74. Housing 58 further defines enlarged openings at either axial end of bore 88. Referring to FIG. 3, the radially inner surface of housing 58 at each opening is shaped to define a plurality of radially outer, circumferentially spaced cavities 90 that open into a radially interior space 92. In the illustrated embodiment, housing 58 defines five cavities 90 in each opening such that the circumferential center of a cavity 90 is spaced seventy-two (72) degrees from the center of a circumferentially adjacent cavity 90. It should be understood, however, that the number of cavities 90 may vary. In certain embodiments, the cavities 90 formed in the opening at one end of housing 58 are circumferentially shifted or offset from the cavities 90 formed in the other end of housing 58. In particular, the cavities 90 formed in the opening at one end of housing 58 may be circumferentially shifted or offset by a number of degrees equal to three hundred and sixty (360) degrees divided by a total number of the cavities 90 in the two openings. Thus, in the illustrated embodiment, the cavities in one end of housing 58 may be circumferentially shifted of offset relative to the cavities 90 in the other end of housing 58 by thirty-six (36) degrees. Each cavity 90 is configured to receive a fluid volume control member 80 or 82. The fluid volume control member 80 or 82 defines a fluid chamber 94 within the cavity 90 that is sealed relative to the interior space 92. Referring to FIG. 2, housing 58 further defines a plurality of fluid inlets 96, 98 and fluid outlets 100, 102. In particular, and with reference to FIG. 3, housing 58 defines a fluid inlet 96 or 98 for each fluid chamber 94 that is connected to a fluid source at one end and to a fluid chamber 94 at another end. In the embodiment illustrated in FIG. 2, compressor 32 comprises a two-stage compressor such that the fluid inlets 96 in the first stage of the compressor (on the left-hand side of FIG. 2) may be coupled to atmospheric air and the fluid inlets 98 in the second stage of the compressor (on the right-hand side of FIG. 2) may be coupled to the fluid outlets 100 in the first stage. Referring again to FIG. 3, housing 58 further defines a fluid outlet 100 or 102 for each fluid chamber 94 that is connected to a fluid chamber 94 at one end and to a fluid destination at another end. Again, in the embodiment illustrated in FIG. 2, the fluid outlets 100 in the first stage of the compressor may be coupled to the fluid inlets 98 in the second stage of the compressor. The fluid outlets 102 in the second stage of the compressor may be connected to air dryer 34. In the illustrated embodiment, the fluid outlets 100 in the first stage are in direct fluid communication with the fluid inlets 98 in the second stage. In an alternative embodiment, the fluid outlets 100 in the first stage and fluid inlets 98 in the second stage may be connected to an intercooler 84, such as a heat exchanger, to allow cooling of the fluid before introduction to the second stage of compressor 32.

Fluid intake manifolds 60, 64 are provided to divide a consolidated fluid stream from a fluid source into to individual fluid streams for delivery to fluid chambers 94 through fluid inlets 96 98, respectively. Fluid discharge manifolds 62, 66 are provided to consolidate individual fluid streams output from fluid chambers 94 through fluid outlets 100, 102, respectively, into a consolidated fluid stream for delivery to a fluid destination. Although some of the fluid manifolds 60, 66 are represented as separate structures relative to housing 58 in the illustrated embodiment, it should be understood that any or all of fluid manifolds 60, 62, 64, 66 could alternatively be formed within housing 58. In the illustrated embodiment, separate intake manifolds 60, 64 and discharge manifolds 62, 66 are used for each stage of the two-stage compressor 32. It should be understood, however, that a single intake manifold and single discharge manifold could be used in some embodiments (e.g., where compressor 32 is configured as a single state compressor).

Referring again to FIG. 3, inlet valves 68 are provided to control the flow of fluid from fluid inlets 96, 98 into the fluid chambers 94 within cavities 90. Outlet valves 70 are provided to control the flow of fluid from the fluid chambers 94 into the fluid outlets 100, 102. Inlet valves 68 and outlet valves 70 are supported within housing 58. Inlet valves 68 are configured and positioned within fluid inlets 96, 98 such that fluid pressure in the fluid inlet 96, 98 from a fluid source that is greater than the fluid pressure within the fluid chamber 94 opens the inlet valve 68 to allow fluid to flow from the fluid source into the fluid chamber 94 while fluid pressure in the fluid chamber 94 greater than the fluid pressure within the fluid inlet 96, 98 closes the inlet valve 68 to prevent fluid flow. Outlet valves 70 are configured and positioned within fluid outlets 100, 102 such that fluid pressure in the fluid chamber 94 that is greater than the fluid pressure in the fluid outlet 100, 102 opens the outlet valve 70 to allow fluid to flow to the fluid destination while fluid pressure in the fluid outlet 100, 102 greater than the fluid pressure within the fluid chamber 94 closes the outlet valve 70 to prevent fluid flow. Inlet valves 68 and outlet valves 70 may comprise disc valves or reed valves in certain embodiments.

Shaft 72 is provided to transfer torque from motor 56 to rotors 76, 78. Shaft 72 is disposed within bore 88 in housing 58 and supported for rotation therein by bearing 74. Shaft 72 is configured for rotation about axis 86. Shaft 72 comprises an eccentric shaft, however, such that a center of shaft 72 is offset from axis 86 and the geometric centers of shaft 72 and rotors 76, 78 rotate in circles about the rotational axis 86. Shaft 72 may be coupled at one end to motor 56.

Bearing 74 is provided to allow shaft 72 to rotate relative to housing 58 and to allow rotors 76, 78 to slip over shaft 72 and rotate in the opposite direction relative to shaft 72. Although a single bearing 74 supporting rotors 76, 78 is shown in the illustrated embodiment, separate bearings 74 may be used to support rotors 76, 78. Bearing 74 may comprise a radial bearing, but it should be understood that bearings configured to absorb axial and radial loads may also be used.

Figure 4:
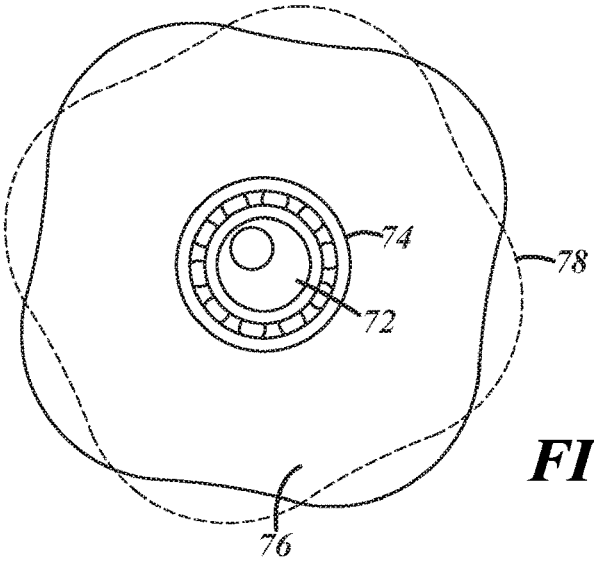
FIG. 4 is a diagrammatic view of illustrating the relative positions of a pair of rotors in the compressor of FIG. 2.

Rotors 76, 78 control the position of the fluid volume control members 80, 82 in order to adjust the volume of the fluid chambers 94 in cavities 90. Referring to FIG. 3, each rotor 76, 78 may comprise a hypocycloid rotor. Each rotor 76, 78 is disposed within the interior space 92 of housing 58 and is supported on shaft 72. Each rotor 76, 78 defines a plurality of lobes 104 that act as cams and are configured for movement into and out of each cavity 90 responsive to rotation of shaft 72 to displace the fluid volume control member 80, 82 in each cavity 90 and adjust a volume of each fluid chamber 94. One or both of the rotors 76, 78 and fluid volume control members 80, 82 may include a coating or other mechanism to reduce friction between the components. The number of lobes 104 on each rotor 76, 78 will be one less than the number of cavities 90 in the corresponding opening within housing 58 in which the rotor 76, 78 is located. Therefore, in the illustrated embodiment, each rotor 76, 78 has four lobes 104. It should again be understood, however, that the number of lobes 104 may vary and will vary in combination with the form of housing 58 and, in particular, the number of cavities 90 formed in the corresponding opening in housing 58 in which the rotor 76, 78 is located. Referring to FIG. 4, in accordance with certain embodiments, rotor 78 may be circumferentially shifted relative to rotor 76. This shift improves the balance of rotors 76, 78 and spaces the displacement of individual fluid volume control members 80, 82 on either side of compressor 32. In the illustrated embodiment in which each rotor 76, 78 has four lobes 104 and the housing 58 defines five cavities 90 at either end, the shifting of rotor 78 relative to rotor 76 results in ten separate actuation events in which a rotor 76, 78 displaces a fluid volume control member 80, 82 during each revolution of the shaft 72 and rotors 76, 78. Rotor 78 is circumferentially shifted relative to rotor 76 by a number of degrees equal to three hundred and sixty (360) degrees divided by a total number of cavities 90 in the two openings in which rotors 76, 78 are located. Thus, in the illustrated embodiment, rotor 78 is circumferentially shifted relative to rotor 76 by thirty-six (36) degrees.

Fluid volume control members 80, 82 control the volume of within fluid chambers 94. A member 80, 82 is disposed within each cavity 90 in housing 58 and defines a fluid chamber 94 within the cavity 90 that is sealed relative to the corresponding interior space 92 in housing 58. With reference to FIG. 3, in one embodiment of the invention, members 80, 82 may comprise diaphragms 106 stretched across each cavity 90. Opposite circumferential ends of the diaphragm 106 may be received within recesses 108 formed in the radially inner surface of housing 58 and, in particular, in circumferentially adjacent, radially inwardly extending protrusions 110 that are formed in the radially inner surface of the housing 58 and define cavities 90. The two recesses 108 receiving opposite circumferential ends of a diaphragm 106 may be disposed within a common plane parallel to axis 86. Diaphragms 106 may be made from a fiber reinforced elastomer in certain embodiments. The diaphragms 106 are capable of movement between an unstressed position establishing a maximum volume of fluid chamber 94 and a stressed position establishing a minimum volume of fluid chamber 94. When diaphragm 94 is in its unstressed state and fluid pressure in fluid inlet 96 or 98 exceeds the fluid pressure in fluid chamber 94, inlet valve 68 is displaced and fluid enters the fluid chamber 94. When rotor 76 or 78 assumes a position in which a lobe 104 of rotor 76, 78 enters cavity 90, the lobe 104 displaces the diaphragm 106 and moves diaphragm 106 to a stressed state. This action reduces the volume of fluid chamber 94 and increases the fluid pressure within fluid chamber 94. Once the fluid pressure within fluid chamber 94 exceeds the fluid pressure in fluid outlet 100 or 102, outlet valve 70 is displaced and fluid exits fluid chamber 94. As the rotor 76 or 78 continues to rotate, the lobe 104 exits the cavity 90 allowing diaphragm 106 to return to the unstressed state. This action increases the volume of fluid chamber 94 and reduces the pressure within fluid chamber 94 until fluid again enters the fluid chamber 94 through inlet 96 or 98 and the process repeats.

Figure 5:
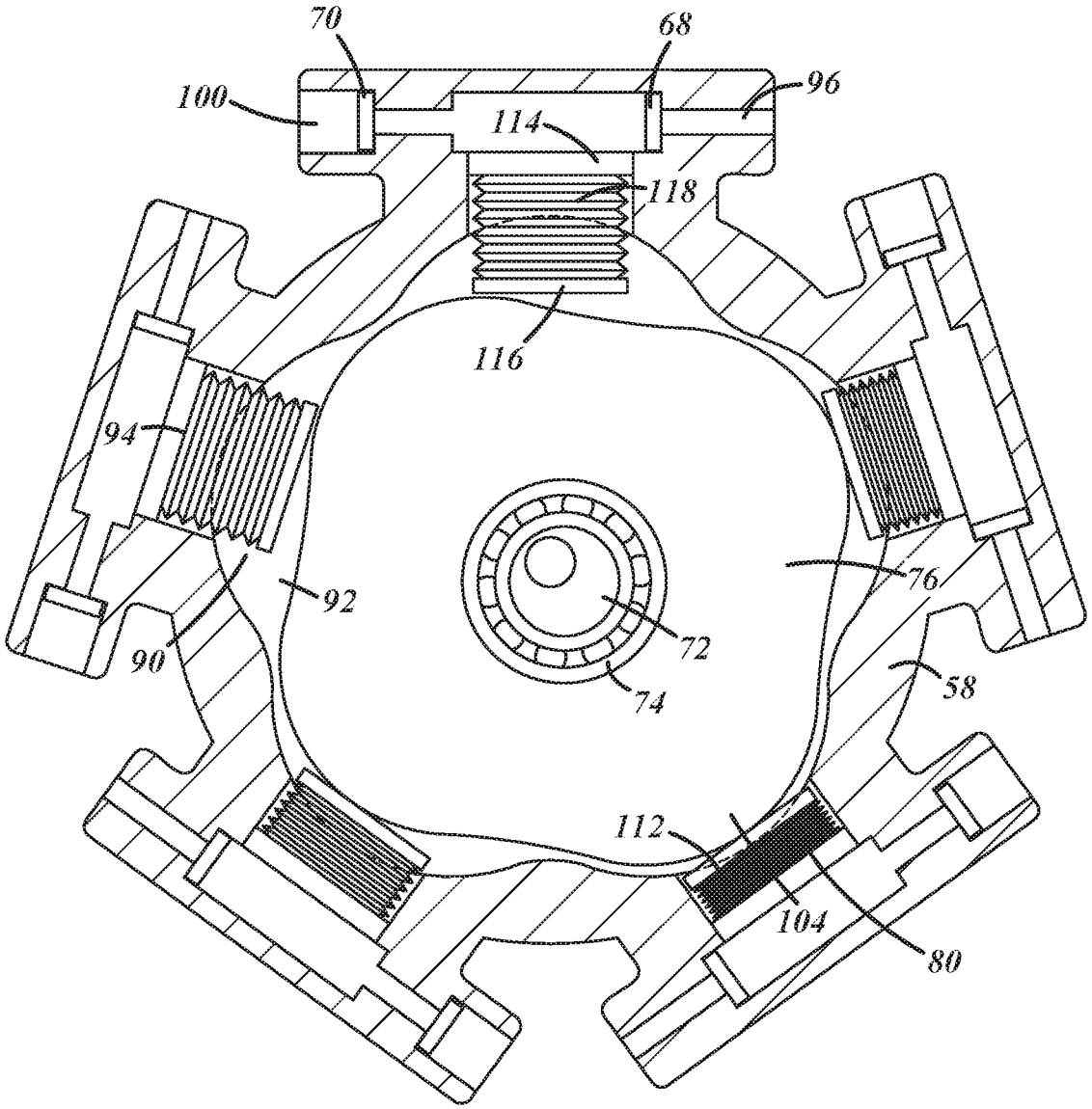
FIG. 5 is cross-sectional view of a portion of a compressor in accordance with another embodiment of the present teachings.

Referring to FIG. 5, in an alternate embodiment fluid volume control members 80, 82 may comprise bellows 112 arranged with cavities 90. Each bellows 112 may contain stationary and movable end plates 114, 116 and a deformable bladder 118 that is coupled to, and extends between plates 114, 116. End plate 114 is fixed within cavity 90. In particular, plate 114 may be coupled to the surface or walls of housing 58 defining a cavity 90 by, for example, an adhesive, weld or another fastener. End plate 116 is spaced from stationary end plate 114 and configured for engagement with rotor 76 or 78. Bladder 118 is connected between end plates 114, 116 and is a tubular body. The interior of bladder 118 defines a portion of the fluid chamber 94 within cavity 90 and is configured to receive a portion of the fluid in fluid chamber 94. Bellows 112 may assume an expanded state and a contracted state. When bellows 112 is in its expanded state and fluid pressure in fluid inlet 96 or 98 exceeds the fluid pressure in fluid chamber 94, inlet valve 68 is displaced and fluid enters the fluid chamber 94. When rotor 76 or 78 assumes a position in which a lobe 104 of rotor 76, 78 enters cavity 90, the lobe 104 compresses bellows 112 and moves bellows 112 towards a contracted state. This action reduces the volume of fluid chamber 94 and increases the fluid pressure within fluid chamber 94. Once the fluid pressure within fluid chamber 94 exceeds the fluid pressure in fluid outlet 100 or 102, outlet valve 70 is displaced and fluid exits fluid chamber 94. As the rotor 76 or 78 continues to rotate, the lobe 104 exits the cavity 90 allowing bellows 112 to return to the expanded state. This action increases the volume of fluid chamber 94 and reduces the pressure within fluid chamber 94 until fluid again enters the fluid chamber 94 through inlet 96 or 98 and the process repeats.

Figure 6:
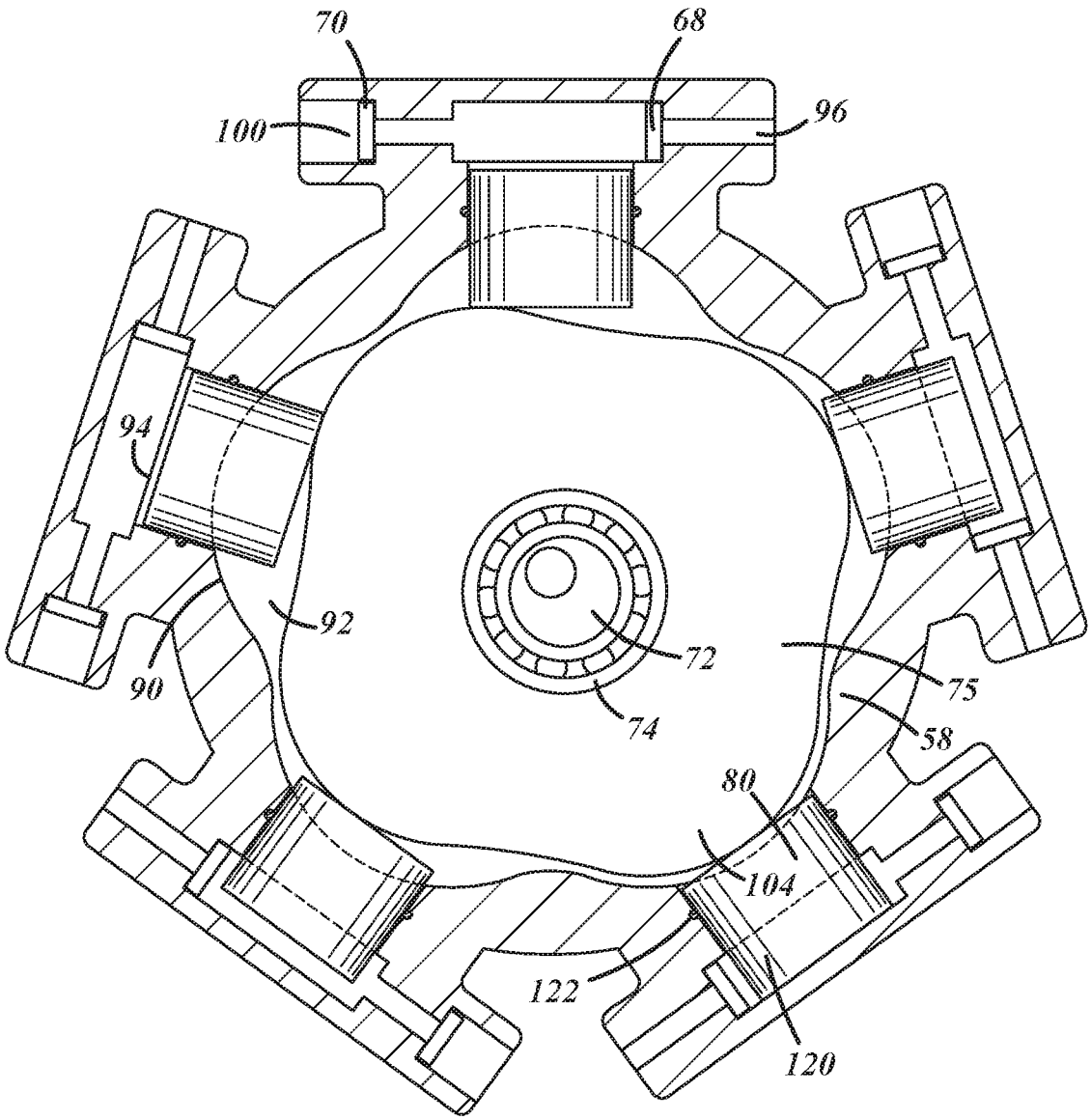
FIG. 6 is cross-sectional view of a portion of a compressor in accordance with another embodiment of the present teachings.

Referring to FIG. 6, in another alternative embodiment, fluid volume control members 80, 82 may comprise pistons 120 arranged within cavities 90. Each piston 120 is disposed within, and movable within, a cavity 90. A seal 122 may be disposed between the piston 120 and the surface or walls of housing 58 defining the cavity 90. Pistons 120 are movable between one position establishing a maximum volume of fluid chamber 94 and another position establishing a minimum volume of fluid chamber 94. When piston 120 is in the position establishing a maximum fluid volume of fluid chamber 94 and fluid pressure in fluid inlet 96 or 98 exceeds the fluid pressure in fluid chamber 94, inlet valve 68 is displaced and fluid enters the fluid chamber 94. When rotor 76 or 78 assumes a position in which a lobe 104 of rotor enters cavity 90, the lobe 104 displaces the piston 120 and moves piston 120 to the position corresponding to a minimum fluid volume of the fluid chamber 94. This action reduces the volume of fluid chamber 94 and increases the fluid pressure within fluid chamber 94. Once the fluid pressure within fluid chamber 94 exceeds the fluid pressure in fluid outlet 100 or 102, outlet valve 70 is displaced and fluid exits fluid chamber 94. As the rotor 76 or 78 continues to rotate, the lobe 104 exits the cavity 90 allowing the piston 120 to return to the position establishing a maximum fluid volume in fluid chamber 94. This return motion can be affected by a spring or other biasing member. This action increases the volume of fluid chamber 94 and reduces the pressure within fluid chamber 94 until fluid again enters the fluid chamber 94 through inlet 96 or 98 and the process repeats. In certain embodiments incorporating pistons 120, inlet valve 68 may be eliminated. In particular, the piston 120 itself could open and close the pathway between fluid inlet 96 or 98 and fluid chamber 94 during its movement within cavity 90. The pistons 120 may be less efficient in case of leakage around the seals 122 as compared to the diaphragms 106 and bellows 112.

A compressor 32 in accordance the present teachings represent an improvement as compared to conventional compressors. In particular, the compressor 32 disclosed herein has a relatively smooth torque profile and is capable of operating smoothly at relatively high speeds unlike conventional positive displacement, reciprocating compressors. Further, the compressor 32 reduces or eliminates fluid leakage past the compressor vanes and is therefore more efficient than conventional positive displacement, rotary compressors. As a result, the compressor facilitates the use of electric motors 56 to drive the compressor 32.

While the invention has been shown and described with reference to one or more particular embodiments thereof, it will be understood by those of skill in the art that various changes and modifications can be made without departing from the spirit and scope of the invention.

What is claimed is:

1. A compressor, comprising:

a stationary housing disposed about a central axis and having a radially inner surface defining a plurality of circumferentially spaced cavities opening into an interior space of the housing;

a plurality of fluid volume control members, each of the plurality of fluid volume control members disposed within one of the plurality of cavities and defining a fluid chamber within the cavity sealed relative to the interior space;

an eccentric shaft disposed within the interior space of the housing, a geometric center of the eccentric shaft configured for rotation in a circle about the central axis; and, a hypocycloid rotor disposed within the interior space of the housing and supported on the eccentric shaft, a geometric center of the hypocycloid rotor configured for rotation in the circle about the central axis, the hypocycloid rotor defining a plurality of lobes configured for movement into and out of each cavity of the plurality of cavities responsive to rotation of the eccentric shaft about the central axis to displace the fluid volume control member in each cavity and adjust a volume of each fluid chamber.

2. The compressor of claim 1 wherein each of the plurality of fluid volume control members comprises a flexible diaphragm.

3. The compressor of claim 2 wherein opposite circumferential ends of the diaphragms are received within recesses formed in circumferentially adjacent, radially inwardly extending protrusions that are formed in the radially inner surface of the housing, each of the protrusions disposed between circumferentially adjacent cavities of the plurality of the cavities.

4. The compressor of claim 1 wherein each of the plurality of fluid volume control members comprises a bellows.

5. The compressor of claim 1 wherein each of the plurality of fluid volume control members comprises a piston.

6. The compressor of claim 5, further comprising a seal disposed within each of the plurality of cavities and configured to engage the piston and an opposed wall of the housing.

7. The compressor of claim 1, further comprising:

a plurality of inlet valves supported within the housing, each of the plurality of inlet valves configured to control fluid flow between one of the fluid chambers and a corresponding fluid inlet to the one fluid chamber; and, a plurality of outlet valves supported within the housing, each of the plurality of outlet valves configured to control fluid flow between one of the fluid chambers and a corresponding fluid outlet in the one fluid chamber.

8. The compressor of claim 7 wherein the fluid inlets for the fluid chambers are in fluid communication with a common fluid intake manifold and the fluid outlets for the fluid chambers are in fluid communication with a common fluid discharge manifold.

9. A compressor, comprising:

a stationary housing disposed about a central axis and having a radially inner surface defining a first plurality of circumferentially spaced cavities opening into a first interior space of the housing and a second plurality of circumferentially spaced cavities opening into a second interior space of the housing, the first plurality of cavities and first interior space axially spaced from the second plurality of cavities and second interior space;

a first plurality of fluid volume control members, each of the first plurality of fluid volume control members disposed within one of the first plurality of cavities and defining a fluid chamber within the cavity sealed relative to the first interior space;

a second plurality of fluid volume control members, each of the second plurality of fluid volume control members disposed within one of the second plurality of cavities and defining a fluid chamber within the cavity sealed relative to the second interior space;

an eccentric shaft disposed within the interior space of the housing and configured for rotation about the central axis;

a first hypocycloid rotor disposed within the first interior space of the housing and supported on a first portion of the eccentric shaft, the first hypocycloid rotor defining a plurality of lobes configured for movement into and out of each cavity of the first plurality of cavities responsive to rotation of the eccentric shaft about the central axis to displace the first fluid volume control member in each cavity and adjust a volume of each fluid chamber; and, a second hypocycloid rotor disposed within the second interior space of the housing and supported on a second portion of the eccentric shaft, the second hypocycloid rotor defining a plurality of lobes configured for movement into and out of each cavity of the second plurality of cavities responsive to rotation of the eccentric shaft about the central axis to displace the second fluid volume control member in each cavity and adjust a volume of each fluid chamber.

10. The compressor of claim 9 wherein the second hypocycloid rotor is circumferentially shifted relative to the first hypocycloid rotor by a number of degrees equal to 360 degrees divided by a total number of the first plurality of cavities and the second plurality of cavities.

11. The compressor of claim 9 wherein fluid output from the fluid chambers in the first plurality of cavities is input to the fluid chambers in the second plurality of cavities.

12. The compressor of claim 11 wherein fluid output from the fluid chambers in the first plurality of cavities is cooled before input to the fluid chambers in the second plurality of cavities.

13. The compressor of claim 9 wherein each of the first and second pluralities of fluid volume control members comprises a flexible diaphragm.

14. The compressor of claim 13 wherein opposite circumferential ends of the diaphragms are received within recesses formed in circumferentially adjacent, radially inwardly extending protrusions that are formed in the radially inner surface of the housing, each of the protrusions disposed between circumferentially adjacent cavities of a corresponding one of the first and second pluralities of the cavities.

15. The compressor of claim 9 wherein each of the first and second pluralities of fluid volume control members comprises a bellows.

16. The compressor of claim 9 wherein each of the first and second pluralities of fluid volume control members comprises a piston.

17. The compressor of claim 16, further comprising a sea disposed within each of the first and second pluralities of cavities and configured to engage the piston and an opposed wall of the housing.

18. The compressor of claim 9, further comprising:

a first plurality of inlet valves supported within the housing, each of the first plurality of inlet valves configured to control fluid flow between one of the fluid chambers in the first plurality of cavities and a corresponding fluid inlet to the one fluid chamber;

a first plurality of outlet valves supported within the housing, each of the first plurality of outlet valves configured to control fluid flow between one of the fluid chambers in the first plurality of cavities and a corresponding fluid outlet in the one fluid chamber;

a second plurality of inlet valves supported within the housing, each of the second plurality of inlet valves configured to control fluid flow between one of the fluid chambers in the second plurality of cavities and a corresponding fluid inlet to the one fluid chamber; and, a second plurality of outlet valves supported within the housing, each of the second plurality of outlet valves configured to control fluid flow between one of the fluid chambers in the second plurality of cavities and a corresponding fluid outlet in the one fluid chamber.

19. The compressor of claim 18 wherein the fluid inlets for the fluid chambers in the first plurality of cavities are in fluid communication with a first common fluid intake manifold, the fluid outlets for the fluid chambers in the first plurality of cavities are in fluid communication with a first common fluid discharge manifold, the fluid inlets for the fluid chambers in the second plurality of cavities are in fluid communication with a second common fluid intake manifold and the fluid outlets for the fluid chambers in the second plurality of cavities are in fluid communication with a second common fluid discharge manifold.

20. A method for compressing fluid, comprising the steps of:

providing a compressor comprising a stationary housing disposed about a central axis and having a radially inner surface defining a plurality of circumferentially spaced cavities opening into an interior space of the housing;

a plurality of fluid volume control members, each of the plurality of fluid volume control members disposed within one of the plurality of cavities and defining a fluid chamber within the cavity sealed relative to the interior space;

an eccentric shaft disposed within the interior space of the housing, a geometric center of the eccentric shaft configured for rotation in a circle about the central axis; and, a hypocycloid rotor disposed within the interior space of the housing and supported on the eccentric shaft, a geometric center of the hypocycloid rotor configured for rotation in the circle about the contra axis the hypocycloid rotor defining a plurality of lobes; and, rotating the eccentric shaft and hypocycloid rotor about the central axis wherein the plurality of lobes on the hypocycloid rotor move into and out of each cavity of the plurality of cavities to displace the fluid volume control member in each cavity and adjust a volume of each fluid chamber.

* * * * *